US005953834A

United States Patent [19]

Clodic

[11] Patent Number: 5,953,834

[45] Date of Patent: Sep. 21, 1999

[54] FOOTWEAR OR CLOTHING ARTICLE WITH INTEGRAL THERMAL REGULATION ELEMENT

[75] Inventor: Denis Clodic, Paris, France

[73] Assignee: A.R.M.I.N.E.S.- Association Pour La Recherche et Le Developpement des Methodes et Processus Industriels, Paris, France

[21] Appl. No.: 09/011,093

[22] PCT Filed: Aug. 9, 1996

[86] PCT No.: PCT/FR96/01270

§ 371 Date: May 21, 1998

§ 102(e) Date: May 21, 1998

[87] PCT Pub. No.: WO97/06396

PCT Pub. Date: Feb. 20, 1997

[30] Foreign Application Priority Data

Aug. 9, 1995 [FR] France ..... 95 09660

[51] Int. Cl.[6] ..... A43B 7/02; A43B 7/06

[52] U.S. Cl. ..... 36/2.6; 36/3 A

[58] Field of Search ..... 36/3 R, 3 A, 3 B, 36/2.6, 113, 116

[56] References Cited

U.S. PATENT DOCUMENTS

| | | | |
|---|---|---|---|
| 2,153,304 | 4/1939 | Gruber | 36/3 R |
| 2,397,413 | 3/1946 | Evans | 36/3 R |
| 2,442,026 | 5/1948 | Thompson, Jr. | 36/3 R X |
| 3,044,188 | 7/1962 | Evangelista | 36/3 R |
| 3,128,566 | 4/1964 | Burlison et al. | 36/3 R |
| 4,397,104 | 8/1983 | Doak | 36/3 B X |
| 4,835,883 | 6/1989 | Tetrault et al. | 36/3 R |
| 5,515,622 | 5/1996 | Lee | 36/3 R |

FOREIGN PATENT DOCUMENTS

| | | | |
|---|---|---|---|
| 8605663 | 10/1986 | WIPO | 36/2.6 |

*Primary Examiner*—B. Dayoan
*Attorney, Agent, or Firm*—Young & Thompson

[57] ABSTRACT

Footwear or clothing article with integral thermal regulation element, includes a heat pipe (3) with a first portion, or source area (3*a*) in heat exchange contact with a relatively warm region (2) of the wearer's body, and another portion, or sink area (3*b*) in heat exchange contact with another region of the wearer's body or with the atmosphere, so as to transfer the heat (Q1) produced by the warm body region from the source area (3*a*) to the sink area (3*b*) of the heat pipe.

11 Claims, 2 Drawing Sheets

FOOTWEAR OR CLOTHING ARTICLE WITH INTEGRAL THERMAL REGULATION ELEMENT

CROSS REFERENCE TO RELATED APPLICATION

This application is the 35 USC §371 national stage of international application PCT/FR96/01270 filed on Aug. 9, 1996, which designated the United States of America.

FIELD OF THE INVENTION

The present invention relates to an article of clothing or footwear having a heat-conditioning element incorporated therein.

BACKGROUND OF THE INVENTION

It has been known for a long time to equip footwear or articles of clothing with heating means of different types, namely electrical, with liquid or gaseous fuel, etc. The heating systems incorporated in such articles obviously present several drawbacks, such as the substantial increase in the cost price of the article, its weight and bulk.

Furthermore, articles of footwear and clothing are also known which are provided with ventilation means to evacuate the heat emitted by the human body. However, the transfer of heat towards the outside cannot always be effected under satisfactory conditions due to the presence of thermally insulating layers of the article and this results in a sensation of discomfort for the wearer of these articles.

The document EP-A-0 059 581 discloses a clothing article of the vest type containing heat paths, which is connected by an independent external heat path and a connector with a heat sink.

The document WO-A-9 213 600 also discloses a vest containing an inflatable heat path, the internal wall of the vest being in contact with the body of the wearer and forming a source region whilst its external wall forms a sink region to discharge heat from the body to the atmosphere.

SUMMARY OF THE INVENTION

The present invention aims at overcoming these drawbacks, allowing a sensitive part of the body to be heated or cooled without employing an outside source of energy, by very simple means which may be incorporated very easily in the articles.

To that end, this article of clothing or footwear having a heat-conditioning element incorporated therein, is characterized in that it comprises a heat pipe of which at least a first part or source zone is in heat exchange contact with a relatively hot zone of the body of the wearer of the article and at least another part or well zone is in heat exchange contact with another zone of the wearer's body or with the outside, so as to transmit the heat produced by the hot zone of the body, from the source zone towards the well zone of the heat pipe, with a view to evacuating the heat towards the outside of the article, or to warming, by this heat, that part of the body located in the immediate proximity of the well zone of the heat pipe.

As is well known, the heat pipe is a heat transfer element comprising, in a thin volume defined by a tight enclosure, a fluid with change of liquid/vapour phase, such as water under its vapour tension. The heat pipe which constitutes an element for heat conditioning the article of clothing or footwear may be integrated in this article or added thereon.

The invention may be applied to various types of articles such as shoes, gloves, headbands or bonnets covering the ears, overalls, etc.

BRIEF DESCRIPTION OF THE DRAWINGS

Various forms of embodiment of the present invention will be described hereinafter by way of non-limiting examples, with reference to the accompanying drawings, in which.

DETAILED DESCRIPTION OF THE INVENTION

Figure 1:
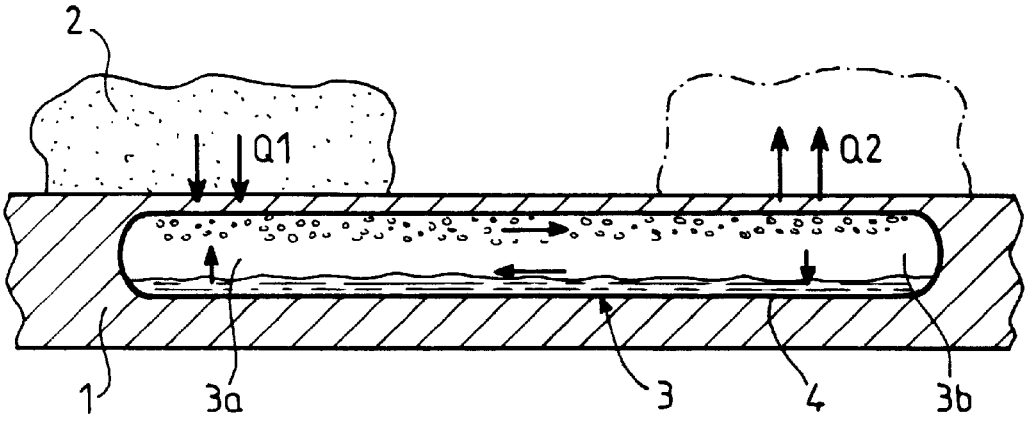
FIG. 1 is a schematic view in section illustrating the effect of heat conditioning of a heat pipe incorporated in an article of clothing or footwear.

Referring now to FIG. 1, the principle of the heat transfer employed according to the present invention in an article of clothing or footwear will firstly be described. In the following specification, the term article of clothing will be understood to mean both a garment proper and any other article which may be placed in contact with a part of the body, such as a blanket for example. This Figure schematically shows a face 1 of the article, this face being able to be a thickness of fabric, a wall or sole of a shoe, a thickness of a blanket, etc. This face 1 is in contact with a part 2 of the body of the wearer of the article, which part is at a relatively high temperature. The article according to the invention has been designed to capture the major part of the heat Q1 produced by the part 2 of the body and to transfer this heat either outside the face 1 of the article, or towards the interior, in the direction of another part of the body having to be warmed. According to the present invention, the heat conditioning element which is used to ensure this transfer of heat is constituted by a heat pipe 3 which extends between a source zone 3*a,* located opposite the hot part 2 of the body, and a well zone 3*b* remote from the source zone 3*a* and from which the heat Q2 is released to the outside. This heat pipe 3 is constituted by a tight enclosure, closed on itself, containing a fluid with change of liquid/vapour phase, such as for example water under its vapour tension. The heat pipe 3 is relatively thin and its dimensions are much exaggerated in FIG. 1 in order to facilitate understanding of the invention. The wall 4 of the heat pipe is composed of two thin sheets welded to each other along their edges, made of a good heat-conducting material such as a metal or a metal-containing plastics material. The thin inner volume of the heat pipe 3 may be free, as shown in FIG. 1, or it may contain an inner gauze 6, such as a metal cloth, which performs simultaneously a role of spacer and of capillary drainage of the liquid phase.

The working principle of the heat pipe 3 is well known. The heat, represented by arrows Q1, produced by part 2 of the body, causes boiling of the fluid in the source zone 3*a* of the heat pipe 3, and the steam thus produced moves towards the colder zone or well zone 3*b* of the heat pipe 3, where this heat is rendered to the outside as indicated by arrows Q2. In the well zone 3*b,* the steam condenses and the fluid having returned to the liquid state returns to the source zone 3*a*. The path of the fluid within the heat pipe 3 is indicated by arrows in FIG. 1.

Figure 2:
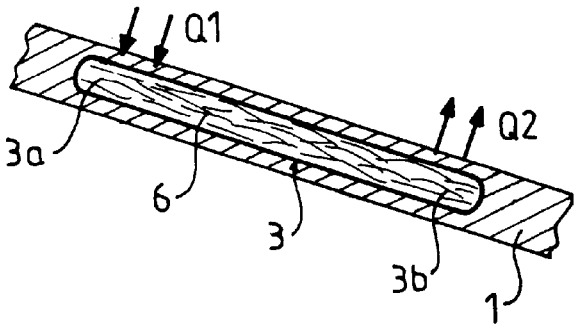
FIG. 2 is a view in section of a variant embodiment of the heat conditioning element.

The liquid phase may be transferred from the well zone 3*b* towards the source zone 3*a,* for re-supply, under the sole effect of gravity and in that case the heat Q1 must imperatively be supplied at the low point of the heat pipe 3 and evacuated (heat Q2) at the high point of the heat pipe. No inner gauze 6 is in that case required. The liquid phase may also be transferred for re-supply solely by the capillary route and the liquid of the condensed phase may be resupplied, from the well zone 3*b* to the source zone 3*a*, at the same altitude and even from a lower level than the evaporation level, as illustrated in FIG. 2. In that case, the presence of an inner gauze 6 in the heat pipe 3 is indispensable. Finally, the transfer may also be effected jointly under the effect of gravity and capillarity and, in that case, the gauze 6 is obviously necessary.

An application of the invention to a safety shoe will now be described with reference to FIG. 3. The safety shoe shown in FIG. 3, generally designated by reference 7, comprises a body 8, an outer sole 9, an inner anti-intrusion or anti-penetration sole 11 and, at the rear of the leg part, a rear stiffener 12 for protecting the heel. According to the invention, the inner anti-intrusion sole 11 contains, in its thickness, a thin heat pipe 13 which extends over the whole length of the sole and is extended by end parts 13*a*, 13*b* extending upwardly and constituting well zones. The front end part 13*a* is curved rearwardly so as to take the shape of a front shell 14 for protecting the shoe. The rear end part 13*b* extends substantially vertically in the rear stiffener 12 for protecting the heel.

The heat of the foot of the wearer of the safety shoe 7 is supplied by the zones of abutment of the foot, namely the sole and the heel, on the anti-intrusion sole 11 and it is transferred by conduction in the source zone of the heat pipe 13 housed in the sole 11. In fact, in this particular application, the heat pipe 13 comprises two source zones located respectively below the zones of abutment of the sole and the heel. The heat introduced in the source zones of the heat pipe 13 causes the fluid with change of phase to boil and this heat is transmitted to the front (13*a*) and rear (13*b*) end parts of the heat pipe which constitute its well zones. The heat released to the outside in the well zones 13*a*, 13*b* is evacuated via air circulation conduits provided in the walls of the shoe. At the front, a first air circulation conduit 15 leaves from a lower air admission orifice 16, provided in the front of the shell of the shoe, and it arrives at an air outlet orifice 17 provided on the top of the shoe. At the rear, a rear circulation conduit 18 leaves from a lower air admission orifice 19, located at the base of the rear stiffener, and arrives at an air outlet orifice 20 located higher up in the stiffener. Consequently, the air circulates, by natural convection, in the front (15) and rear (18) conduits, as indicated by the arrows, and it sweeps the front (13*a*) and rear (13*b*) well zones of the heat pipe 13 to evacuate the heat towards the outside.

In the embodiment of the shoe shown in FIG. 3, the anti-intrusion sole 11 is also equipped with a forced ventilation device and to that end, it presents a lower air circulation conduit 21 extending over the whole length of the sole, below the heat pipe 13 and communicating, at its ends, with the front (15) and rear (18) air circulation conduits. A passage 22 is provided in the anti-intrusion sole 11, in the zone of abutment of the wearer's heel, to communicate the inside of the shoe with the lower circulation conduit 21. This makes it possible to use the periodical pressure of the wearer's heel on the rear part of the anti-intrusion sole 11 to produce a pump effect promoting circulation of the air below the heat pipe 13 and in the front (15) and rear (18) circulation conduits. The front (16) and rear (19) air admission orifices may be provided with adjustable flaps (28, 29) which allow evacuation of the pumped air towards the outside when they are open or the channeling of the air towards the well zones 13*a*, 13*b* of the heat pipe 13 when they are closed.

Figure 3:
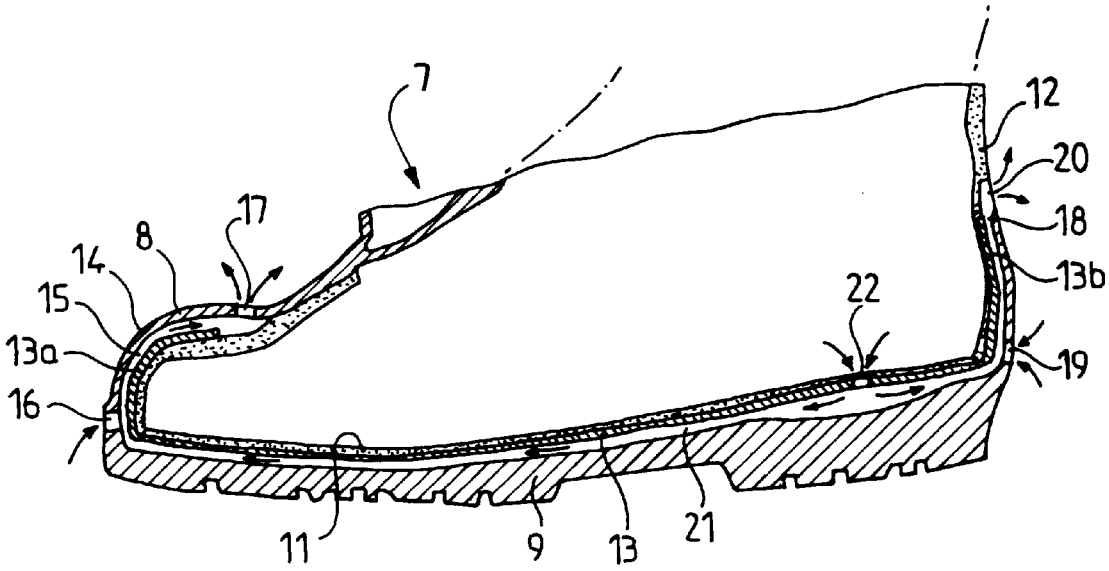
FIG. 3 is a view in vertical and partial longitudinal section of a safety shoe comprising, in its sole, a heat pipe for evacuating the heat from the foot towards the outside.

Although the shoe 7 illustrated in FIG. 3 comprises a heat pipe 13 with two front (13*a*) and rear (13*b*) well zones, it goes without saying that it might comprise only one of these well zones.

From the foregoing description, it is seen that it is possible to cool the foot as long as the temperature of the air is less than the maximum temperature of the skin of the foot which is of the order of 33° C. for normal physical exercise and which may attain 40° C. in the case of prolonged physical exercises (running). In the thermal zone defined, with an air temperature less than 30° C. or possibly 40° C., the transfer of heat to the outside is adjustable. It may therefore be increased, stabilized or even cancelled depending on the user's comfort requirements.

Figure 4:
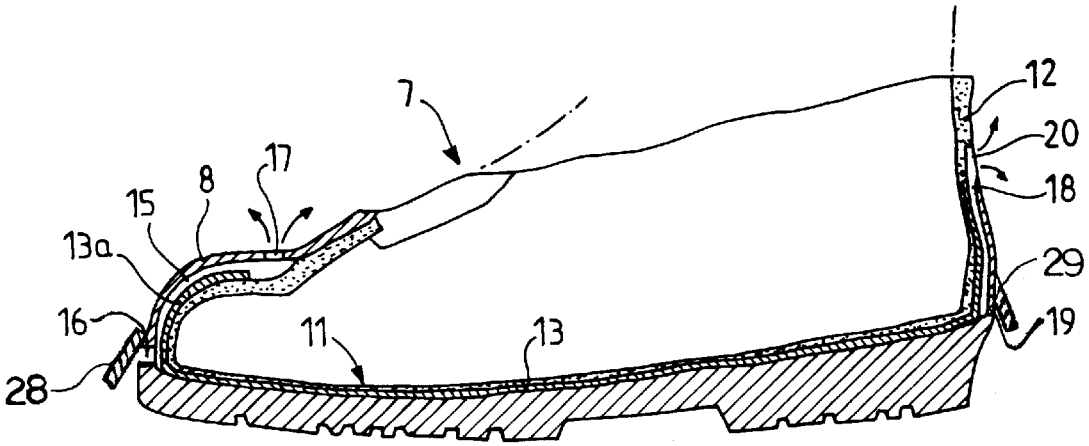
FIG. 4 is a view in vertical and longitudinal section of a variant embodiment of the shoe shown in FIG. 3.

FIG. 4 shows a variant embodiment of the safety shoe of FIG. 3, not provided with the air circulation pump. In that case, the lower conduit 21 is not provided in the anti-intrusion sole 11. There again, the adjustable flaps (28, 29) which are provided in the lower air admission orifices 16 and 19 allow circulation of the air, by the chimney effect, in the front (15) and rear (18) conduits and they cancel this circulation when they are closed.

Figure 5:
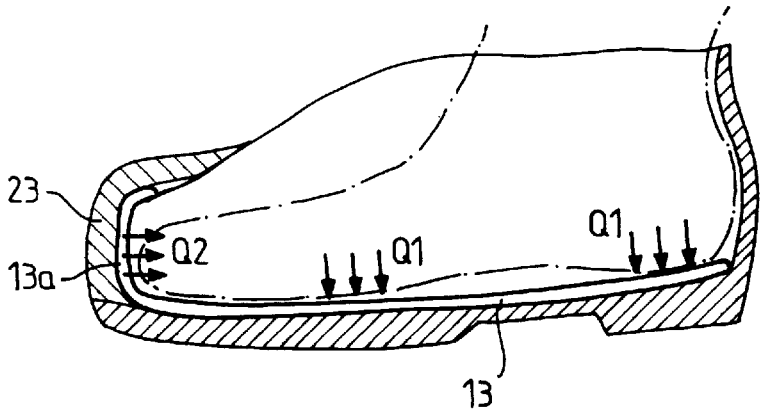
FIG. 5 is a schematic view in vertical and longitudinal section of a variant embodiment of the shoe adapted to warm the wearer's toes.

Referring now to FIG. 5, a variant embodiment of a shoe according to the invention will be described. In this case, the heat produced by the hottest parts of the underneath of the foot, namely the heel and the sole, is not evacuated to the outside, but is recovered at the front of the shoe to warm the wearer's toes. Consequently, the heat pipe 13 comprises just one front well zone 13*a* which is located in the immediate proximity of the toes. This well zone 13*a* is isolated at maximum from the outside by the front wall of the shoe. In FIG. 5, the heat Q2 emitted by the well zone 13*a* is represented by arrows directed toward the wearer's toes and it is transferred by hot wall, convection and radiation effect.

According to a variant, instead of being integrated in the wall of the shoe, the front well zone 13*a* may be added by a securing of the wearer's sock by means of a device of the self-gripping type and, in that case, the transfer of heat is in addition conductive through the fabric.

In the case of the shoe ensuring cooling of the toes, as is illustrated in FIG. 5, the sole containing the heat pipe 13 may no longer be integrated in the shoe itself but it may on the contrary be added inside it. According to a first variant, the added sole, containing the heat pipe 13, may be placed in the shoe outside the wearer's sock so as to imprison the foot like a slipper. According to another variant, the sole containing the heat pipe 13 may be included inside the sock and, in that case, the material of the heat pipe 13 is a supple material.

Figure 6:
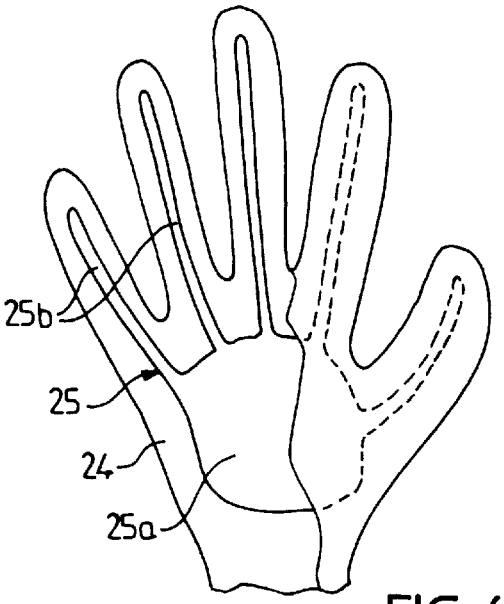
FIG. 6 is a schematic plan view, with parts torn away, of a glove equipped with a heat pipe for warming the wearer's fingers.

FIG. 6 represents the application of the invention to a glove 24 whose face contains a heat pipe 25. This heat pipe comprises a source zone 25*a,* of relatively large surface, in heat exchange contact with the palm of the wearer's hand, and well zones 25*b* located in the respective fingers of the glove, to warm the wearer's fingers which are particularly sensitive to the cold. The heat pipe 25 thus comprises five relatively narrow channels, constituting the well zones 25*b*, which communicate with the source zone 25*a*. The heat produced by the wearer's palm is consequently transmitted to the source zone 25*a* and from there it is distributed towards the well zones 25*b* located in heat exchange contact with the wearer's fingers.

Figure 7:
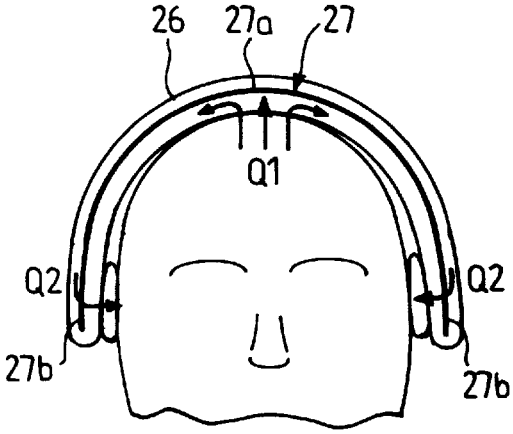
FIG. 7 is a schematic view in vertical section of a bonnet covering the wearer's ears and provided with a heat pipe for warming his/her ears.

FIG. 7 illustrates the application of the invention to a bonnet or an ear muff 26 containing a heat pipe 27, extending over the head and covering the wearer's two ears which are sensitive to the cold. The source zone 27*a* of the heat pipe 27 receives the heat Q1 emitted by the wearer's head and the well zones 27*b* restore the heat Q2 at the level of the ears to warm them up.

According to a variant, the heat pipe 27 might also be incorporated in a balaclava covering the head, its source zone 27*a* being in contact with the rear of the head and its two well zones 27*b* in contact with the wearer's two ears.

The invention might also be incorporated in overalls, source zones of the heat pipe in that case being in contact with the hot zones of the body, constituted by the chest and abdomen, while the well zones would be in contact with extremities of the body which are particularly sensitive to the cold.

Although the foregoing description is directed to applications of the invention to articles that may be used by human beings, it goes without saying that the invention may also be applied to articles intended to be borne by animals, such as blankets, etc.

I claim:

1. A shoe comprising a shell having a front part, a rear stiffener, and an inner sole; said inner sole containing a heat pipe including a source zone in heat exchange contact with a part of a wearer's foot so as to receive heat therefrom, and at least one sink zone in heat exchange contact with another part of the wearer's foot so as to transmit heat thereto, said heat pipe extending over the whole length of the sole, and containing a fluid with change of liquid/vapor phase; said at least one sink zone being constituted by an end part of the heat pipe extending upwardly.

2. The shoe according to claim 1, wherein the heat pipe comprises a front end part extending upwardly in the front part of the shell and constituting a sink zone.

3. The shoe according to claim 2, wherein the heat pipe further comprises a rear end part extending upwardly in the rear stiffener of the shell and constituting a sink zone.

4. The shoe according to claim 1, wherein the heat pipe includes two sink zones, and along each sink zone of the heat pipe, there extends a respective air circulation conduit, each air circulation conduit extending between a lower air admission orifice and an upper air outlet orifice.

5. The shoe according to claim 4, wherein each lower air admission orifice is provided with a flap.

6. The shoe according to claim 4, further comprising a lower air circulation passageway having two ends, and extending over the whole length of the sole, below the heat pipe, said passageway communicating at its ends with each air circulation conduits; and a passage provided in the sole in a zone of abutment of the wearer's heel, in order to cause the interior of the shoe to communicate with the lower circulation passageway.

7. The shoe according to claim 1, wherein the heat pipe comprises only one front sink zone located in the immediate proximity of the wearer's toes, said front sink zone being isolated from the outside by a front wall of the shoe so that heat emitted by said front sink zone is directed towards the wearer's toes, and the sole containing the heat pipe is integrated in the shoe.

8. The shoe according to claim 1, wherein the heat pipe comprises only one front sink zone located in the immediate proximity of the wearer's toes, said front sink zone being isolated from the outside by a front wall of the shoe so that heat emitted by said front sink zone is directed towards the wearer's toes, and the sole containing the heat pipe is added in the interior of the shoe.

9. The shoe according to claim 8, wherein the added sole, containing the heat pipe is placed in the shoe outside the wearer's sock.

10. The shoe according to claim 8, wherein the added sole, containing the heat pipe is included inside the wearer's sock, and the material of the heat pipe is made of a supple material.

11. The shoe according to claim 5, further comprising a lower air circulation passageway having two ends, and extending over the whole length of the sole, below the heat pipe, said passageway communicating at its ends with each air circulation conduits; and a passage provided in the sole in a zone of abutment of the wearer's heel, in order to cause the interior of the shoe to communicate with the lower circulation passageway.

* * * * *